US005839260A

United States Patent [19]

Brody

[11] Patent Number: 5,839,260

[45] Date of Patent: Nov. 24, 1998

[54] PACKAGING SYSTEM

[75] Inventor: Harvey Brody, Costa Mesa, Calif.

[73] Assignee: Norvey, Inc., Santa Ana, Calif.

[21] Appl. No.: 840,330

[22] Filed: Apr. 28, 1997

Related U.S. Application Data

[62] Division of Ser. No. 614,630, Mar. 13, 1996, Pat. No. 5,664,683.

[51] Int. Cl.[6] ..... B65B 43/10; B65B 43/26

[52] U.S. Cl. ..... 53/456; 53/458; 53/471

[58] Field of Search ..... 53/456, 449, 462, 53/471, 458, 485, 48.1

[56] References Cited

U.S. PATENT DOCUMENTS

| | | | |
|---|---|---|---|
| 2,119,789 | 6/1938 | Krout | 150/50 |
| 2,812,852 | 11/1957 | Samuels | 206/44 |
| 2,914,236 | 11/1959 | Shapiro | 229/34 |
| 3,817,018 | 6/1974 | Vickers | 53/462 |
| 3,986,319 | 10/1976 | Puskarz et al. | 53/462 X |
| 3,987,892 | 10/1976 | Killy | 206/44 |
| 4,858,414 | 8/1989 | Meschi | 53/462 X |
| 4,871,068 | 10/1989 | Dreyfus | 53/462 X |
| 5,090,178 | 2/1992 | Ricchio | 53/456 |
| 5,323,896 | 6/1994 | Jones | 53/452 X |

*Primary Examiner*—Horace M. Culver
*Attorney, Agent, or Firm*—Klein & Szekeres, LLP

[57] ABSTRACT

A convertible shipping/display carton, having a receptacle portion defined by a bottom, a front wall, a rear wall, a pair of opposed side walls, and a display panel extending vertically from the rear wall includes an extension section joined to the display panel. The extension section includes an extension section fold line adjacent and parallel to its juncture with the display panel, whereby the extension section is foldable along the extension section fold line between a first position in which it extends substantially vertically from the display panel, and a second position in which it extends substantially horizontally to overly the receptacle portion. A method of packaging articles of merchandise using this carton includes the steps of placing a plurality of articles of merchandise in the receptacle portion while the extension section is in its substantially vertical position; folding the extension section along the extension section fold line to its substantially horizontal position; placing an open-bottomed HSC carton over the shipping/display carton; and securing the HSC carton to the bottom of the shipping/display carton. Alternatively, two or more shipping/display cartons can be vertically stacked after being loaded with merchandise having their extension sections folded horizontally. The stack is then enclosed in an HSC carton, which is secured to the bottom-most shipping/display carton.

8 Claims, 3 Drawing Sheets

PACKAGING SYSTEM

CROSS-REFERENCE TO RELATED APPLICATION

This application is a divisional of application Ser. No. 08/614,630, filed on Mar. 13, 1996, and now U.S. Pat. No. 5,664,683.

BACKGROUND OF THE INVENTION

The present invention relates generally to the field of containers and packaging methods. More specifically, it relates to a folded cardboard or paperboard carton for shipping, storing, and displaying articles of merchandise, and to methods of making the carton and of packaging the articles in it.

A wide variety of cardboard or corrugated paperboard cartons have been devised for shipping and storing articles of merchandise, wherein the same carton that is used for shipping and storing the merchandise is converted to a container for a "point of purchase" display of the merchandise at the location where the merchandise is offered for sale. One of the more popular types of such convertible cartons is of the type shown in FIG. 1, wherein a prior art shipping/display carton 10 is shown in its display configuration. In this configuration, the carton 10 comprises a flat bottom 11, a vertical front wall 12, a vertical rear wall 13, and a pair of opposed vertical side walls 14. The carton 10 includes a "pop-up" display panel 15 that is connected to the rear wall 14. As shown in FIG. 1, the display panel 15 is disposed in a vertical, open position, thereby allowing articles of merchandise 16 to be seen and selected for purchase. In this open configuration, the display panel 15 extends upwardly from the rear wall 13 to provide a location for the display of textual and graphical information (not shown) in order to advertise the merchandise (i.e., "point of purchase" advertising).

The display panel 15 comprises an outer section 15*a* and an inner section 15*b*, with a "pop-up" section 17 partially cut out from the outer section 15*a* and connected along one side to the inner section 15*b*. The display panel 15 may be folded into a closed position (not shown), in which the outer section 15*a* and the inner section 15*b* extend horizontally so as to form a lid or cover over the articles 16. When the display panel 15 is opened, it is first lifted, and then the inner section 15*b* is folded down over the inside surface of the outer section 15*a*, causing the "pop-up" section 17 to be displaced outwardly and upwardly from the outer section 15*a* and rotated 180 degrees to form a raised central part of the display panel 15, and thereby leaving an open cut-out 18 in the outer section 15*a* that is covered by the folded-over inner section 15*b*.

The prior art carton 10 is manufactured by a process that is similar to the process described below in connection with the preferred embodiment of the present invention, with several notable differences that provide a point of novelty of the present invention.

One disadvantage of the prior art carton 10 is that the pop-up display panel 15 generally limits the number of articles 16 that the carton 10 can hold. Thus, more cartons 10 must be used for a given number of articles 16, thereby raising packaging costs.

Another disadvantage derives from the fact that the cartons 10 are typically shipped with the display panels 15 in their closed positions. Thus, when they arrive at their destination and it is desired to display the merchandise, it is necessary to perform the above-described plurality of steps to open the display panels 15 to their vertical positions, and to expose the "pop-up" section 17.

It would thus provide a significant advantage over the prior art to modify the carton 10 so as to increase the number of articles of merchandise it can hold. It would be a further advantage to simplify the procedure for converting the carton from a closed shipping configuration to an open display configuration, including a central "pop-up" section, whereby the display panel and its "pop-up" section are already substantially deployed in the display configuration during shipping.

SUMMARY OF THE INVENTION

Broadly, one aspect of the present invention is an improved convertible shipping/display carton formed from a folded piece of cardboard or paperboard, of the type comprising a bottom, a vertical front wall, a pair of opposed vertical side walls, a vertical rear wall, and a display panel, including a "pop-up" extension section, that is joined to the rear wall, wherein the improvement comprises the display panel being permanently disposed in a vertical position, with the "pop-up" extension section being selectably deployable in a first or vertical position extending upwardly from the rest of the display panel, and a second or horizontal position overlying the carton bottom.

More specifically, the display panel comprises an inner display panel section and an outer display panel section, joined along a display panel fold line, with the inner and outer display panel sections folded together along the display panel fold line to form the display panel as a vertical extension of the rear wall. A "pop-up" extension section is formed in the outer display panel section by partially cutting out an area of the outer display panel section along three sides, leaving one side along which the extension section is joined to the inner display panel section. The extension section includes an extension section fold line adjacent and parallel to its juncture with the inner display panel section. To put the display panel into its vertical position, the inner display panel section is folded down over the inside surface of the outer display panel section, causing the extension section to be displaced outwardly and upwardly from the outer display panel section, thereby leaving an open cut-out in the outer display panel section that is covered by the folded-over inner display panel section. The pop-up extension section is thereby rotated approximately 180 degrees so as to be oriented in its vertical position, extending vertically upwardly from the rest of the display panel. The "pop-up" extension section can then be folded along the extension section fold line to its aforementioned horizontal position.

In another aspect, the present invention is a method of packaging articles of merchandise using the above-described convertible shipping/display carton, comprising the steps of (1) vertically placing first and second pluralities of the articles respectively in first and second cartons that are constructed in accordance with the present invention, when the pop-up extension sections of the cartons are in their vertical position; (2) folding the pop-up extension sections of the first and second cartons into their horizontal positions; (3) placing the second carton on top of the first carton; (4) placing an open-bottomed shipping carton over the first and second cartons; and (5) securing at least two sides of the open-bottomed shipping carton to the bottom of the first carton.

The present invention thus provides a packaging system that yields increased packaging capacity (in terms of number of units per carton) as compared with prior art packaging systems of this general type, using a modification of current manufacturing methods that is simple and economical to implement, thereby decreasing overall packaging costs. Furthermore, the present invention allows the cartons to be shipped in a configuration in which the display panel and its pop-up section are nearly fully deployed, thereby minimizing the number of steps that need to be performed when it is desired to display the merchandise contained in the cartons. These advantages, as well as others, will be more readily appreciated from the detailed description that follows.

DETAILED DESCRIPTION OF THE PREFERRED EMBODIMENT

Figure 2:
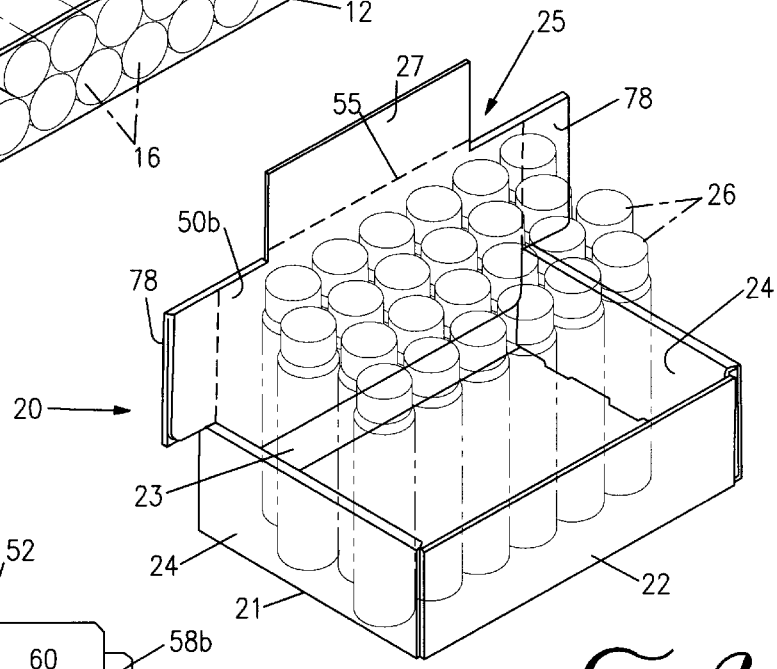
FIG. 2 is a perspective view of a folded cardboard or paperboard carton, in accordance with a preferred embodiment of the present invention, showing the carton in its open position, for the display of articles of merchandise.

FIG. 2 illustrates an improved convertible shipping/display carton 20 in accordance with a preferred embodiment of the present invention. The carton 20 comprises an open receptacle portion defined by a flat bottom 21, a vertical front wall 22, a vertical rear wall 23, and a pair of opposed vertical side walls 24. The carton 20 includes a display panel 25 that is connected to the rear wall 23, and that includes an integral pop-up extension section 27. The display panel 25 extends vertically upwardly from the rear wall 23 to allow articles of merchandise 26, contained in the carton 20, to be seen and selected for purchase. The display panel 25 and/or the extension section 27 may contain textual and graphical information (not shown) to advertise the merchandise (i.e., "point of purchase" advertising). The extension section 27 may be folded into a horizontal position, as will be described below, in which it overlies the bottom 21 so as to partially cover the articles 26. As can be seen in FIG. 2, the articles 26 are displayed vertically. As will be understood from the description below of FIGS. 4 and 5, the articles 26 are also shipped in this position.

Figure 3A:
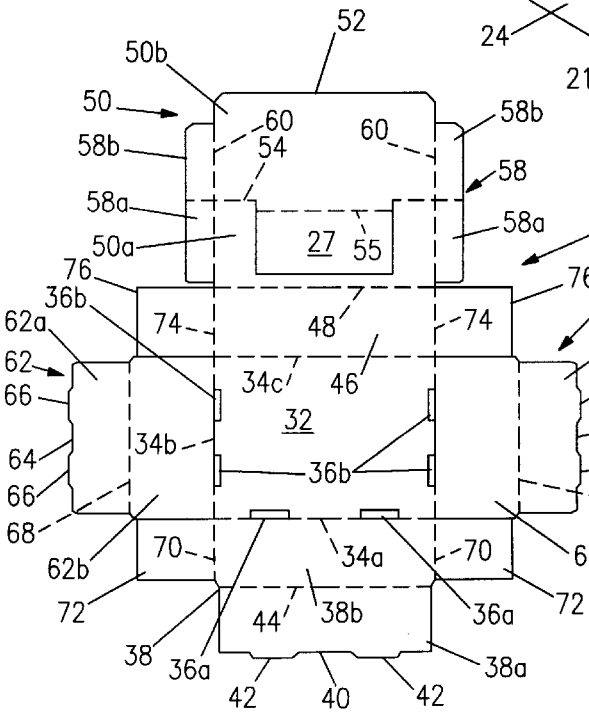
FIGS. 3A through 3L illustrate the steps of the method of manufacturing the carton of FIG. 2.

The carton 20 is manufactured from a flat piece 30 of cardboard or corrugated paper, cut out into the configuration shown in FIG. 3A. In this (and the subsequent) figures, solid lines indicate cut lines, while broken lines indicate fold lines. The flat piece 30 includes a central, rectangular, bottom-forming panel 32 having a front edge 34*a*, a pair of opposed side edges 34*b*, and a rear edge 34*c*. The bottom-forming panel 32 is provided with one or more front slots 36*a* adjacent its front edge 34*a*, and one or more side slots 36*b* adjacent each of its two side edges 34*b*.

Joined to the front edge 34*a* of the bottom-forming panel 32, along a first fold line coincident with the front edge 34*a*, is a substantially rectangular front wall-forming panel 38 that terminates in a terminal edge 40 having one or more tabs 42 that register with the front slots 36*a* adjacent the front edge 34*a* of the bottom-forming panel 32, as will be seen. The front wall-forming panel 38 includes a second fold line 44 extending along its length, substantially parallel to, and approximately half-way between, the terminal edge 40 of the front wall-forming panel 38 and the front edge 34*a* of the bottom-forming panel 32. The second fold line 44 thus divides the front wall-forming panel 38 into an inner front wall-forming panel section 38*a* and an outer front wall-forming panel section 38*b*.

Joined to the rear edge 34*c* of the bottom-forming panel 32, along a third fold line coincident with the rear edge 34*c* of the bottom-forming panel 32, is a rear wall-forming panel 46. Joined to the rear wall-forming panel 46 along a fourth fold line 48 is a display panel-forming portion 50. The display panel-forming portion 50 has a terminating edge 52 and a fifth, or display panel fold line 54 substantially parallel to, and approximately half-way between, the terminating edge 52 and the fourth fold line 48. The display panel fold line 54 thus divides the display panel-forming portion 50 into an outer display panel section 50*a* and an inner display panel section 50*b*. The "pop-up" extension section 27 is formed as a cut-out of the outer display panel section 50*a* by cutting along all sides except for one side, along which it remains joined to the inner display panel section 50*b*. The extension section 27 includes an extension section fold line 55 adjacent and parallel to the juncture between the extension section 27 and the inner display panel section 50*b*.

A side flap 58 is joined to each side edge of the display panel-forming portion 50 along a lateral fold line 60. The display panel fold line 54, which is interrupted by the juncture between the extension section 27 and the inner display panel section 50*b*, extends across the two side flaps 58, dividing them into outer and inner side flap portions 58*a*, 58*b*, respectively.

Extending laterally from each of the side edges 34*b* of the bottom-forming panel 32 is a side wall-forming panel 62, each of which terminates in a terminal edge 64 formed with one or more tabs 66 that register with the side slots 36*b* adjacent the side edges 34*b* of the bottom-forming panel 32. The side wall-forming panels 62 are joined to the bottom-forming panel 32 along fold lines that are respectively coincident with the side edges 34*b* of the bottom-forming panel 32. Each of the side wall-forming panels 62 is formed with a side wall fold line 68, extending front to back, substantially parallel to, and approximately half-way between, the terminal edge 64 of the side wall-forming panel 62 and the side edge 34*b* of the bottom-forming panel 32 to which that side wall-forming panel 62 is attached. The side wall fold lines 68 thus divide each side wall-forming panel 62 into an inner side wall-forming panel section 62*a* and an outer side wall-forming panel section 62*b*.

Extending laterally from each side of the front wall-forming outer panel 38*b*, and joined thereto along a front corner fold line 70, is a front corner-forming flap 72. Extending laterally from each side of the rear wall-forming panel 46, and joined thereto along a rear corner fold line 74, is a rear corner-forming flap 76. The front corner-forming flaps 72 and the rear corner-forming flaps 76 are separated, by cut lines, from the adjacent side wall-forming panels 62.

Figure 1:
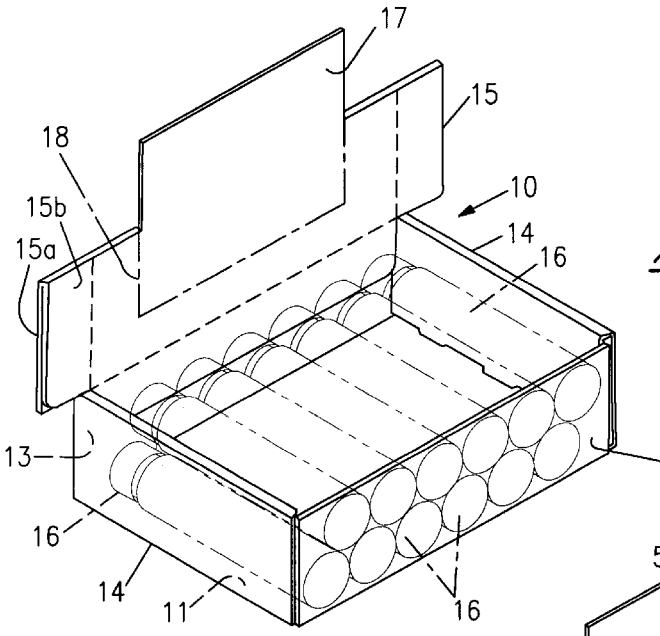
FIG. 1 PRIOR ART
FIG. 1 is a perspective view of a prior art folded cardboard or paperboard carton, in its open position, for the display of articles of merchandise, as described above.

It should be noted that the flat piece 30 of FIG. 3A, as used to make the carton of the present invention, is substantially the same as that which is used to make the prior art carton 10 of FIG. 1, with one notable exception. Specifically, in the flat piece 30 used in making the present invention, the pop-up extension section 27 includes the extension section fold line 55 that is substantially parallel to the display panel fold line 54 that forms a hinge for folding the inner display panel section 50*b* over the outer display panel section 50*a*, as described above. (In some applications, it may be desirable to make the extension section fold line 55 coincident with the display panel fold line 54.) In contrast, in the flat piece use to make the prior art carton 10, the pop-up section 17 lacks a fold line.

Figure 3B:
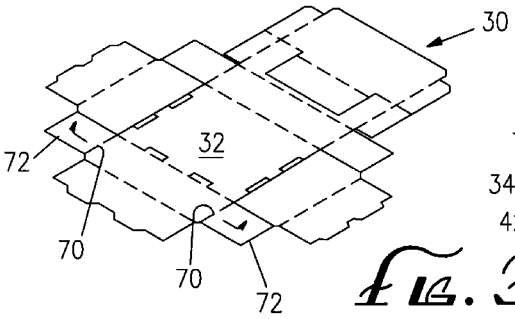
Figure 3C:
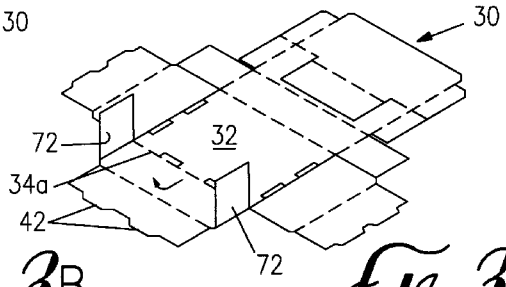
Figure 3D:
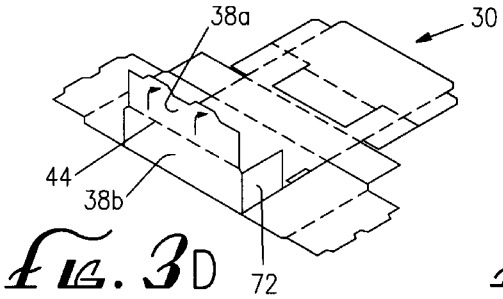
Figure 3E:
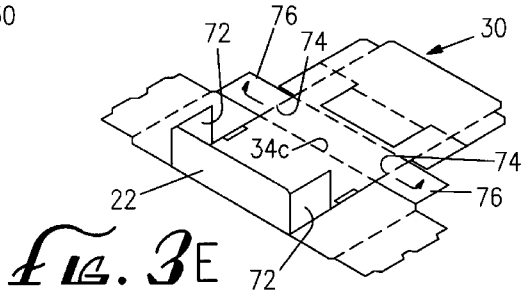
Figure 3F:
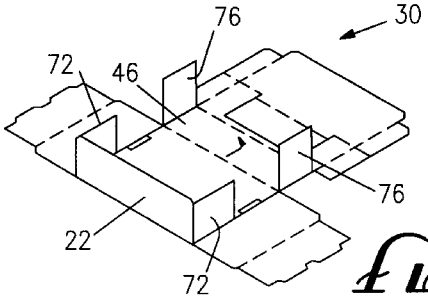
Figure 3G:
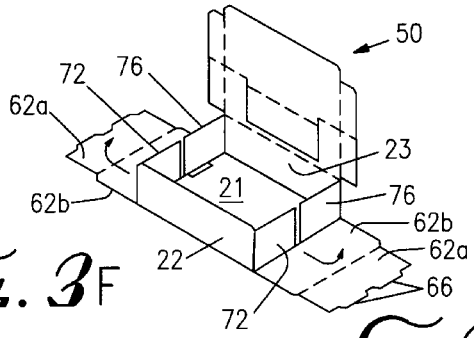

The first step in manufacturing the carton 20 from the flat piece 30 is illustrated in FIGS. 3B and 3C, wherein the front corner-forming flaps 72 are folded upwardly along the front corner fold lines 70. Then, as shown in FIG. 3D, the front wall-forming panel 38 is folded upwardly along the first fold line (the front edge 34*a* of the bottom-forming panel 32) to an upright, vertical position, thereby rotating the front corner-forming flaps 72 by 90 degrees so that they lie along the side edges 34*b* of the bottom-forming panel 32. The inner front wall-forming panel section 38*a* is then folded down, along the second fold line 44, over the inside surface of the outer front wall-forming panel section 38*b* (FIGS. 3D and 3E), so that the tabs 42 on the terminal edge 40 of the front wall-forming panel 38 are received in the front slots 36*a* in the bottom-forming panel 32, thereby forming the front wall 22. The rear corner-forming flaps 76 are then folded upwardly along the rear corner fold lines 74, as shown in FIGS. 3E and 3F, and the rear wall-forming panel 46 is then folded to an upright, vertical position along the third fold line (the rear edge 34*c* of the bottom-forming panel 32), as shown in FIG. 3G. As also shown in FIG. 3G, the folding of the rear wall-forming panel 46 to its upright position rotates the rear corner-forming flaps 76 by 90 degrees, so that they lie along the side edges 34*b* of the bottom-forming panel 32. Thus, in the state shown in FIG. 3G, the front wall 22 and the rear wall 23 of the container 20 are formed, and the display panel-forming portion 50 extends vertically from the rear wall 23.

Figure 3H:
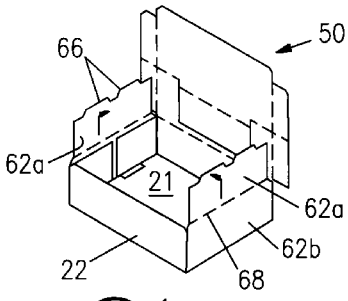
Figure 3I:
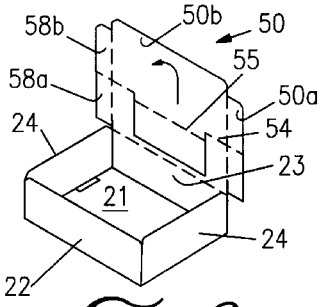

As shown in FIG. 3H, the side wall-forming panels 62 are then folded upwardly, along the sixth and seventh fold lines (the side edges 34*b* of the bottom-forming panel 32), to an upright, vertical position, so that they lie alongside of, and exterior to, the front and rear corner-forming flaps 72, 76. The inner side wall-forming panel sections 62*a* are then folded downwardly, along the side wall fold lines 68, over the inside surfaces of the corner-forming flaps 72, 76. The tabs 66 on the terminal edges 64 of the inner side wall-forming panel sections 62*a* are inserted into the side slots 36*b* adjacent the side edges 34*b* of the bottom-forming section 32, thereby forming the side walls 24 of the container 20 (FIG. 3I).

Figure 3J:
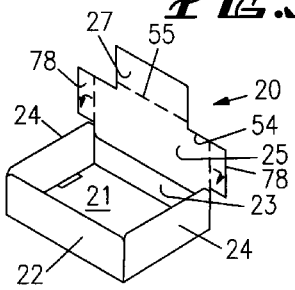

The inner display panel section 50*b* is then folded down, along the display panel fold line 54, over the inside surface of the outer display panel section 50*a*. As shown in FIG. 3J, this latter folding step removes the partially cut-out "pop-up" extension section 27 from the outer display panel section 50*a* and inverts it, so that it extends vertically upwardly from the inner display panel section 50*b*. Thus, the display panel 25 is now formed. This folding step also brings the inner side flap portions 58*b* down over the outer side flap portions 58*a* to form a pair of lateral extensions 78. The configuration shown in FIG. 3J is the "display" configuration, in which the pop-up extension section 27 is disposed vertically above the inner display panel section 50*b* to allow any textual or graphic material that may be printed on it to be viewed. In this configuration, the lateral extensions 78 are disposed so as to be substantially coplanar with the rear extension portion 25.

Figure 3K:
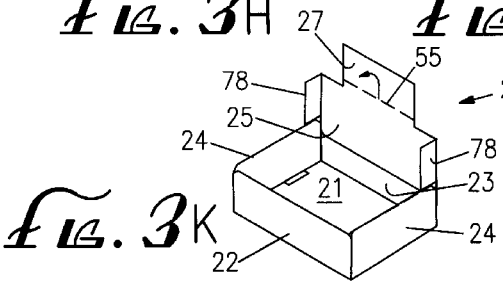
Figure 3L:
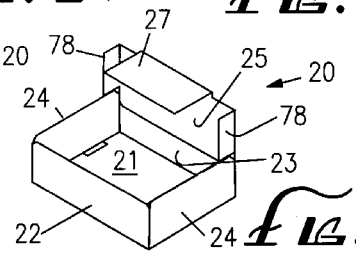

FIGS. 3K and 3L illustrate the conversion of the carton 20 from the "display" configuration to the "shipping" configuration. First, as shown in FIG. 3K, the lateral extensions 78 are folded forwardly (toward the front wall 22) approximately 90 degrees along the lateral fold lines 60. Then, as shown in FIG. 3L, the pop-up extension section 27 is folded forwardly approximately 90 degrees, along the extension section fold line 55, so that it lies substantially horizontal and parallel to the container bottom 21, thereby overlying the receptacle portion of the carton 20.

Figure 4:
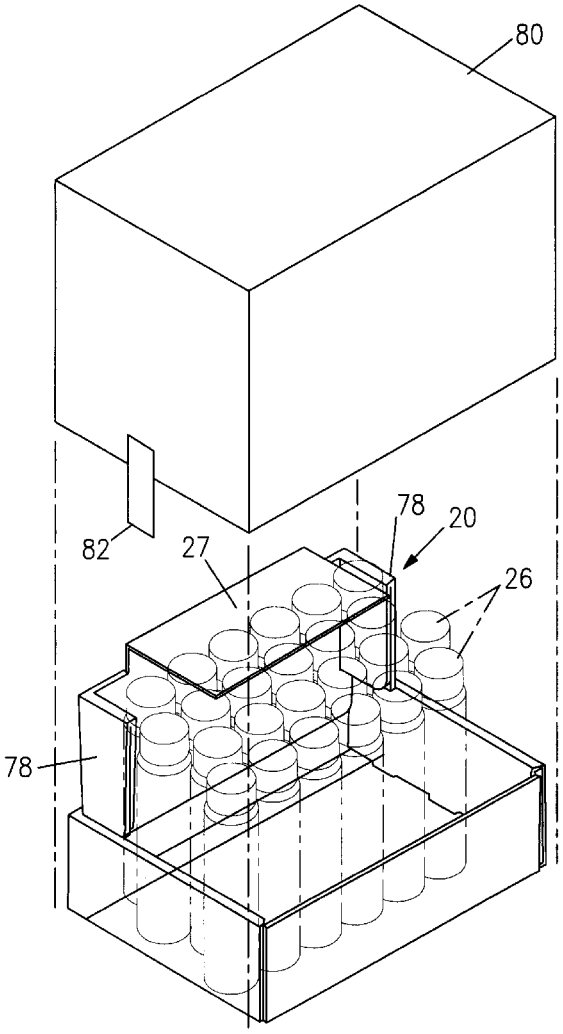
FIGS. 4 and 5 are perspective views illustrating the method of packaging articles of merchandise using the carton of FIG. 2.

FIG. 4 shows the carton 20, in its shipping configuration, holding a plurality of elongate merchandise articles 26 in a vertical position. The carton 20, with its load of articles 26, is shown being packed in an "HSC" carton 80 for shipping. The HSC carton 80 is a staple of commerce, comprising a box having four sides and a folded flap top, but no bottom. The articles 26 are loaded in the carton 20 while the carton 20 is in its display configuration, with the extension section 27 disposed vertically, as described above. The loaded carton 20 is then converted to its shipping position by folding the extension section 27 to its horizontal position, and by folding the lateral extensions 78 forwardly (as described above with reference to FIGS. 3K and 3L). The HSC carton 80 is then placed over the loaded carton 20, and, finally, at least two opposed sides of the HSC carton 80 are secured to the bottom 21 of the carton 20 by any suitable means, such as strips of tape 82, for example (only one of which is shown in the drawing). When the HSC carton 80 containing the carton 20 arrives at a store where the merchandise is to be displayed and sold, the tape strips 82 are cut, the HSC carton 80 is removed, the lateral extensions 78 are unfolded back to their coplanar position with respect to the display panel 25, and the pop-up extension section 27 is unfolded back to its vertical position (FIG. 2).

Figure 5:
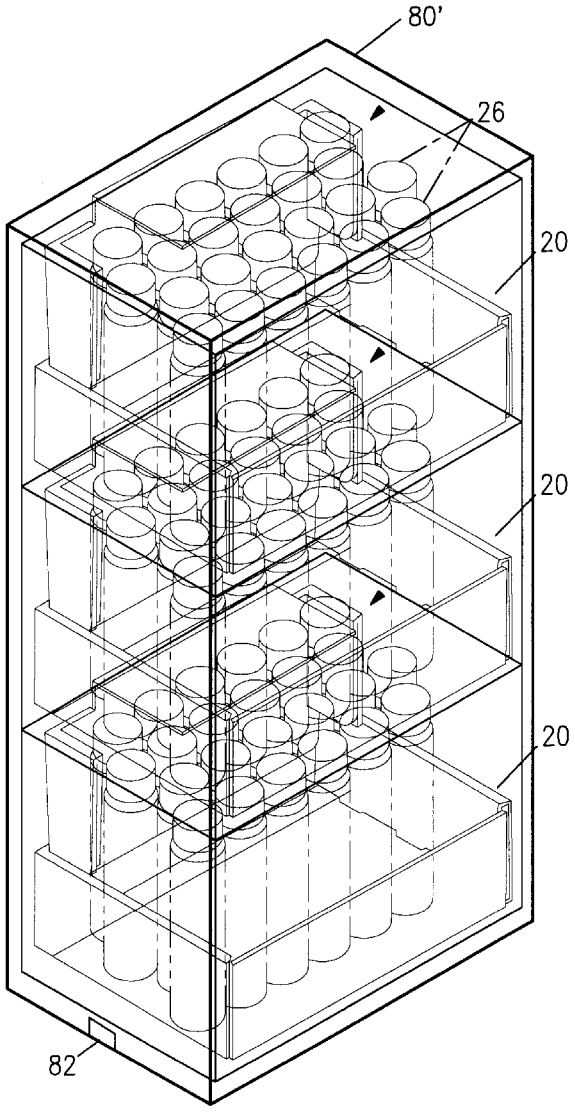

FIG. 5 illustrates the stackability of a plurality of the cartons 20, wherein first, second, and third cartons 20 are loaded with merchandise articles 26 (while in their display configuration) and then converted to their shipping configuration. The first, second, and third cartons are then vertically stacked, one on top of the other, and then an elongated HSC carton 80' is placed over them and secured, as by tape strips 82 (only one of which is shown in the drawing), to the bottom 21 of the first carton.

It will be appreciated that two, three, or even more cartons 20 can be stacked and packed in an HSC carton of suitable dimensions. Furthermore, when multiple cartons 20 are packed in an HSC carton, they may either all be preloaded with merchandise articles before stacking, or each carton may be loaded just prior to being placed on top of the previous carton. Furthermore, the HSC carton may be dimensioned to accommodate two or more stacks of cartons in a side-by-side relationship.

From the foregoing description, it will be appreciated that the present invention offers increased packaging capacity compared with the prior art carton of FIG. 1, and that it allows a quicker conversion from a shipping configuration to a display configuration, due to the fact that the carton 20 is shipped with the display panel 25 in its vertical or open position, with the pop-up section 27 already partially deployed. Furthermore, the present invention eliminates the need for a so-called "master carton", which is a large, sealed carton in which a plurality of individual cartons are shipped, and which must be laboriously opened and unpacked at the sales location. Instead, the present invention allows the use of the HSC carton, which can be quickly and easily unpacked as described above.

While a preferred embodiment of the present invention has been described herein, it will be appreciated that a number of variations and modifications may suggest themselves to those skilled in the pertinent arts. For example, the shape and size of the display panel 25 and the "pop-up" extension section 27 are arbitrary. Likewise, the lateral extensions 78 may be made larger or smaller, as suits the need, or even omitted altogether. These and other variations and modifications should be considered within the spirit and scope of the invention, as defined in the claims that follow.

What is claimed is:

1. A method of packaging articles of merchandise, comprising the steps of:

(a) providing a shipping/display carton having a bottom, a front wall, a rear wall, a pair of opposed side walls, a display panel extending vertically from the rear wall, and an extension section joined to the display panel along an extension section fold line, wherein the bottom, front wall, rear wall, and side walls define a receptacle portion for a plurality of articles of merchandise, and wherein the extension section is foldable along the extension section fold line between a substantially vertical position and a substantially horizontal position;

(b) placing a plurality of articles of merchandise in the receptacle portion while the extension section is in its substantially vertical position;

(c) folding the extension section along the extension section fold line to its substantially horizontal position;

(d) placing an open-bottomed HSC carton over the shipping/display carton; and (e) securing the HSC carton to the bottom of the shipping/display carton.

2. The method of claim 1, wherein the securing step comprises the step of taping at least two sides of the HSC carton to the bottom of the shipping/display carton.

3. The method of claim 1, wherein the shipping\display carton includes a pair of lateral extensions joined to opposite sides of the display panel along a lateral fold line, and wherein the folding step comprises the steps of:

(c)(1) folding the extension section along the extension section fold line to its substantially horizontal position; and (c)(2) folding the lateral extensions toward the front wall along the transverse fold line.

4. The method of claim 3, wherein the securing step comprises the step of taping at least two sides of the HSC carton to the bottom of the shipping/display carton.

5. A method of packaging articles of merchandise, comprising the steps of:

(a) providing a first and second cartons, each having a bottom, a front wall, a rear wall, a pair of opposed side walls, a display panel extending vertically from the rear wall, and an extension section joined to the display panel along an extension section fold line, wherein the bottom, front wall, rear wall, and side walls define a receptacle portion for a plurality of articles of merchandise, and wherein the extension section of each carton is foldable along the extension section fold line between a substantially vertical position and a substantially horizontal position;

(b) placing a plurality of articles of merchandise in the receptacle portions of the first and second cartons while their extension sections are in their substantially vertical position;

(c) folding each of the extension sections along the extension section fold line to its substantially horizontal position;

(d) placing the second carton on top of the first carton;

(e) placing an open-bottomed HSC carton over the first carton; and (f) securing the HSC carton to the bottom of the first carton.

6. The method of claim 5, wherein the securing step comprises the step of taping at least two sides of the HSC carton to the bottom of the first carton.

7. The method of claim 5, wherein the carton includes a pair of lateral extensions joined to opposite sides of the display panel along a lateral fold line, and wherein the folding step comprises the steps of:

(c)(1) folding the extension section along the extension section fold line to its substantially horizontal position; and (c)(2) folding the lateral extensions toward the front wall along the transverse fold line.

8. The method of claim 7, wherein the securing step comprises the step of taping at least two sides of the HSC carton to the bottom of the first carton.

* * * * *